US007084407B2

(12) United States Patent
Ji et al.

(10) Patent No.: US 7,084,407 B2
(45) Date of Patent: Aug. 1, 2006

(54) ION BEAM EXTRACTOR WITH COUNTERBORE

(75) Inventors: Qing Ji, Berkeley, CA (US); Keith Standiford, Carmel, CA (US); Tsu-Jae King, Fremont, CA (US); Ka-Ngo Leung, Hercules, CA (US)

(73) Assignee: The Regents of the University of California, Oakland, CA (US)

( * ) Notice: Subject to any disclaimer, the term of this patent is extended or adjusted under 35 U.S.C. 154(b) by 71 days.

(21) Appl. No.: 10/367,664

(22) Filed: Feb. 13, 2003

(65) Prior Publication Data

US 2003/0168608 A1 Sep. 11, 2003

Related U.S. Application Data

(60) Provisional application No. 60/356,634, filed on Feb. 13, 2002.

(51) Int. Cl.
*H01J 27/00* (2006.01)
*H01J 7/24* (2006.01)

(52) U.S. Cl. ..... 250/423 F; 250/423 R; 315/111.81; 315/111.21

(58) Field of Classification Search ..... 315/111.81, 315/111.21, 111.71, 111.31, 111.41; 250/423, 250/427, 26, 489
See application file for complete search history.

(56) References Cited

U.S. PATENT DOCUMENTS 3,955,091 A * 5/1976 Robinson et al. ..... 250/423 R
4,388,556 A * 6/1983 Rao ..... 315/14
4,540,916 A * 9/1985 Maruyama et al. ..... 315/16
4,682,007 A * 7/1987 Hollander ..... 219/211
5,107,170 A * 4/1992 Ishikawa et al. ..... 313/362.1
5,198,677 A * 3/1993 Leung et al. ..... 250/424
5,233,196 A * 8/1993 Okunuki et al. ..... 250/398
5,365,070 A * 11/1994 Anderson et al. ..... 250/423 R
5,532,483 A * 7/1996 Ose et al. ..... 250/288
5,581,156 A * 12/1996 Roberts et al. ..... 315/111.81
6,617,587 B1 * 9/2003 Parker et al. ..... 250/398

OTHER PUBLICATIONS

Stanley Humphries, "Electron Ion Beams" (Chapt 7),*Charged Particle Beams*, John Wiley & Sons (US), p. 262-327, (Oct. 8, 1990).

Lomer, P.D.;Bounden.J.E; Wood, J.D.L.H., "High Output Neutron Generating Tubes," CONF-650405-2, Services Electronics Rsrch Lab (Baldock, England), p. 623-34, (Sep. 1, 1964).

(Continued)

*Primary Examiner*—Tuyet Thi Vo
(74) *Attorney, Agent, or Firm*—Joseph R. Milner; Adrienne Yeung

(57) ABSTRACT

An extractor system for a plasma ion source has a single (first) electrode with one or more apertures, or a pair of spaced electrodes, a first or plasma forming electrode and a second or extraction electrode, with one or more aligned apertures. The aperture(s) in the first electrode (or the second electrode or both) have a counterbore on the downstream side (i.e. away from the plasma ion source or facing the second electrode). The counterbored extraction system reduces aberrations and improves focusing. The invention also includes an ion source with the counterbored extraction system, and a method of improving focusing in an extraction system by providing a counterbore.

23 Claims, 7 Drawing Sheets

OTHER PUBLICATIONS

Eyrich, W.; Schmidt, A., "Two Compact, High-Intensity Pulsed Neutron Sources," Tehnical Report No. KFK-304; SM-62/4; SM-62/4, Federal Republic of Germany (Germany), p. 589-608, (May 1, 1965).

Lomer, P.D.;Bounden, J.E.; Wood, J.D.L.H., "A Neutron Tube with Constant Output," Nucl. Instr. Methods, Services Electronics Resrch Lab (Baldock, England), p. 283-288, (Mar. 1, 1965).

Erik Oberg, Franklin D. Jones, Holbrook L. Horton, Machinery's Handbook, 20th ed., Industrial Press, Inc (New York, NY), pp. 1670-1671, (Feb. 1, 1980).

Douglas M. Considine, Glenn D. Considine, Van Nostrand's Scientific Encyclopedia, 8th ed., Van Nostrand Reinhold (New York, NY), p. 840, (Feb. 1, 1994).

Bruce A. Wilson, "Dimensioning and Tolerancing Symbols," Drafting Manual, Genium Publishing (US), pp. 1-7, (Feb. 1, 1997).

Eric W. Weisstein, "Cone," Mathworld, A Wolfram Web Resource (http://mathworld.wolfram.com/Cone.html), pp. 1-5, downloaded (Jan. 14, 2005).

Eric W. Weisstein, "Plane," Mathworld, A Wolfram Web Resource (http://mathworld.wolfram.com/Plane.html), pp. 1-6, downloaded (Jan. 14, 2005).

Simon and Schuster, Webster's New Twentieth Century Dictionary, 2nd ed., pp. 380, 416, 698, 1864 (Feb. 1, 1979).

Sybil P. Parker (Editor in chief), McGraw Hill Dictionary of Scientific and Technical Terms, 5th ed., McGraw-Hill (US), pp. 1518, 436, 769, 472, 254 (Feb. 1, 1994).

Thomas E. French and Charles J. Vierck, "Plastics," A Manual of Engineering Drawing for Students and Draftsman, 8th ed., McGraw-Hill Book Company (NY), p. 329, (Apr. 18, 1953).

* cited by examiner

ION BEAM EXTRACTOR WITH COUNTERBORE

RELATED APPLICATIONS

This application claims priority of Provisional Application Ser. No. 60/356,634 filed Feb. 13, 2002, which is herein incorporated by reference.

GOVERNMENT RIGHTS

The United States Government has rights in this invention pursuant to Contract No. DE-AC03-76SF00098 between the United States Department of Energy and the University of California.

BACKGROUND OF THE INVENTION

The invention relates generally to ion beam systems, and more specifically to plasma ion sources of the ion beam systems, particularly beam extraction from the ion sources.

As the dimensions of semiconductor devices are scaled down in order to achieve ever higher level of integration, optical lithography will no longer be sufficient for the needs of the semiconductor industry. Alternative "nanolithography" techniques will be required to realize minimum feature sizes of 0.1 μm or less. Therefore, efforts have been intensified worldwide in recent years to adapt established techniques such as X-ray lithography, extreme ultraviolet lithography (EUVL), and electron-beam (e-beam) lithography, as well as newer techniques such as ion projection lithography (IPL) and atomic-force-microscope (AFM) lithography, to the manufacture of 0.1 μm-generation complementary metal-oxide-semiconductor (CMOS) technology. Significant challenges exist today for each of these techniques: for X-ray, EUV, and projection ion-beam lithography, there are issues with complicated mask technology; for e-beam and AFM lithography, there are issues with low throughput.

Focused ion beam (FIB) patterning of films is a well-established technique (e.g. for mask repair), but throughput has historically been a prohibitive issue in its application to lithographic processes in semiconductor manufacturing. A scanning FIB system would have many advantages over alternative nanolithography technologies if it can be made practical for high volume production. Such a system could be used for maskless and direct (photoresist-less) patterning and doping of films in a semiconductor fabrication process. It would be necessary to focus the beam down to sub-micron spot sizes.

U.S. Pat. No. 5,945,677 to Leung et al. issued Aug. 31, 1999 describes a compact FIB system using a multicusp ion source and electrostatic accelerator column to generate ion beams of various elements with final beam spot size down to 0.1 μm or less and current in the μA range for resist exposure, surface modification and doping.

Conventional FIB columns consist of multiple lenses to focus the ion beams. In order to get smaller feature size, small apertures have to be used to extract the beam and at the same time act as a mask. For the extraction of ions from a plasma source using a long, narrow channel, aberration is always a problem because of the edge effect.

SUMMARY OF THE INVENTION

The invention is an extractor system for a plasma ion source comprising a single (first) electrode or a pair of spaced electrodes, a first or plasma forming electrode and a second or extraction electrode, with one or more aligned apertures, to which suitable voltage(s) are applied, wherein the aperture(s) in the first electrode (and/or second electrode) have a counterbore on the downstream side (i.e. facing the second electrode). The counterbored extraction system reduces aberrations and improves focusing. The invention also includes an ion source with the counterbored extraction system, and a method of improving focusing in an extraction system by providing a counterbore.

DETAILED DESCRIPTION OF THE INVENTION

In a conventional FIB column, multiple electrostatic lenses are used to focus the ion beams. In order to get smaller feature size, small apertures have to be used to extract the beam. For the extraction of ions from a plasma source using a long narrow channel, aberration is always a problem because of the edge effect, and affects focusing.

The present invention changes the geometry of the extraction aperture to reduce aberrations and increase focusing. A counterbore is added on the downstream side to each aperture in the first electrode of the extraction system. This changes the shape of the equipotential lines at the aperture, reducing aberrations and increasing focusing. Thus the invention can use one single lens to achieve reduction image printing.

Figure 1:
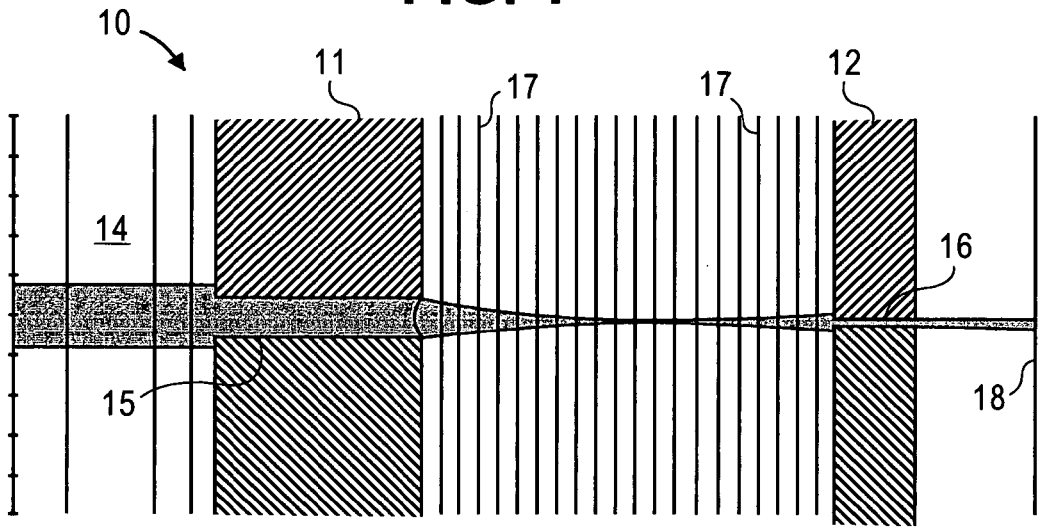
FIG. 1 is an IGUN simulation of the beam trajectories for a prior art ion beam extractor system with a straight aperture geometry.

FIG. 1 shows illustrative beam trajectories calculated with the IGUN code for a prior art ion beam extractor system with a straight aperture geometry. Extractor system 10 has a first or plasma electrode 11 and a spaced second or extraction electrode 12. Ions are electrostatically extracted from an adjacent plasma generation region 14 through aperture 15 in electrode 11 by applying a suitable voltage. Aperture 15 has a straight geometry, i.e. the hole has a constant diameter. The ion beam passing through aperture 15 is directed at an aligned aperture 16 in the second electrode 12 by applying a suitable voltage. Aperture 16 has a straight geometry. Equipotential field lines 17 of the electric field between electrodes 11, 12 bend into aperture 15. The ion beam passing through aperture 15 is focused and begins to diverge again before reaching aperture 16. Thus a portion of the ion beam that strikes electrode 12 is lost. The ion beam passing through aperture 16 is incident on a target 18. (Additional electrodes or lenses may be positioned between electrode 12 and target 18.)

Figure 2:
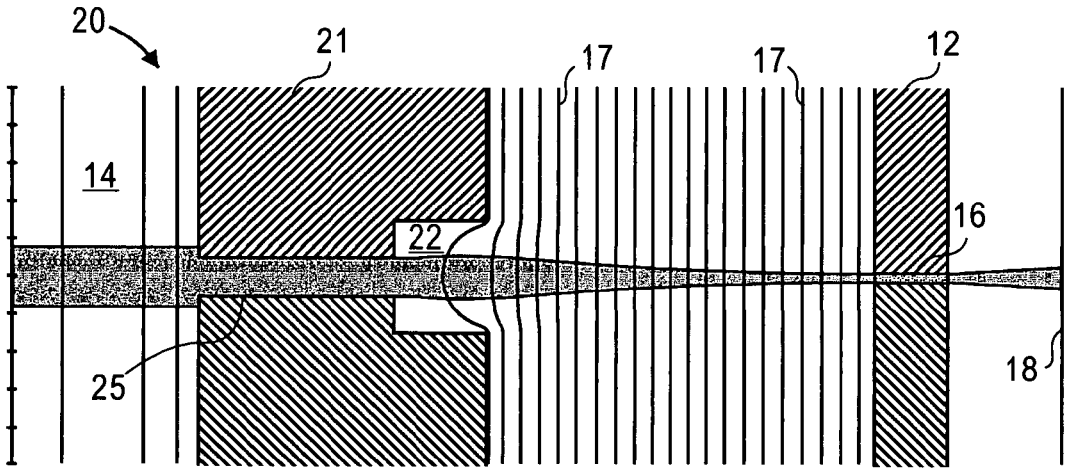
FIG. 2 is an IGUN simulation of the beam trajectories for an ion beam extractor system with a counterbored aperture geometry of the present invention.

FIG. 2 shows illustrative beam trajectories calculated with the IGUN code for an ion beam extractor system of the invention with a counterbored first electrode aperture geometry. Extractor system 20 has a first or plasma electrode 21 and a spaced second or extraction electrode 12. Ions are electrostatically extracted from an adjacent plasma generation region 14 through aperture 25 in electrode 21 by applying a suitable voltage. Aperture 25 has a counterbored geometry, i.e. there is a counterbored hole 22 of greater diameter on the downstream side of electrode 21. The ion beam passing through aperture 25 is directed at an aligned aperture 16 in the second electrode 12 by applying a suitable voltage. Aperture 16 has a straight geometry. Equipotential field lines 17 of the electric field between electrodes 21, 12 bend into counterbore 22. The ion beam passing through aperture 25 is focused down to aperture 16. Thus little of the ion beam strikes electrode 12 and is lost. The ion beam passing through aperture 16 is incident on a target 18. (Additional electrodes or lenses may be positioned between electrode 12 and target 18.) Electrode 12 may be replaced by target 18 (at a suitable voltage), forming a single electrode system with the ion beam passing through aperture 25 directly to the target.

The two systems are compared using a single lens (first electrode) with 100 μm aperture and 500 μm thickness as an example. For the straight hole case, the aperture diameter is 100 μm and the aspect ratio is 5. For the counterbored hole case, the smaller aperture diameter is also 100 μm with 500 μm thickness, while the opening facing downstream (counterbore) is 300 μm in diameter and 250 μm thick. Table 1 lists the aberrations for both systems. The counterbored system reduces all kinds of aberrations dramatically and focuses to a smaller image size.

TABLE 1

| | Straight hole | Counterbored hole |
|---|---|---|
| Object size (μm) | 100.00 | 100.00 |
| Image size (μm) | 27.10 | 22.20 |
| spherical aberration (μm) | 9.11 | 2.55 |
| coma aberration (μm) | 33.23 | 7.95 |
| filed curvature aberration (μm) | 48.67 | 10.06 |
| astigmatism aberration (μm) | 24.23 | 4.96 |
| distortion aberration (μm) | 9.92 | 1.76 |
| chromatic aberration (μm) | 2.55 | 1.92 |
| Total blur (μm) | 64.42 | 14.12 |
| Spot size (μm) | 69.89 | 26.31 |

Figure 3:
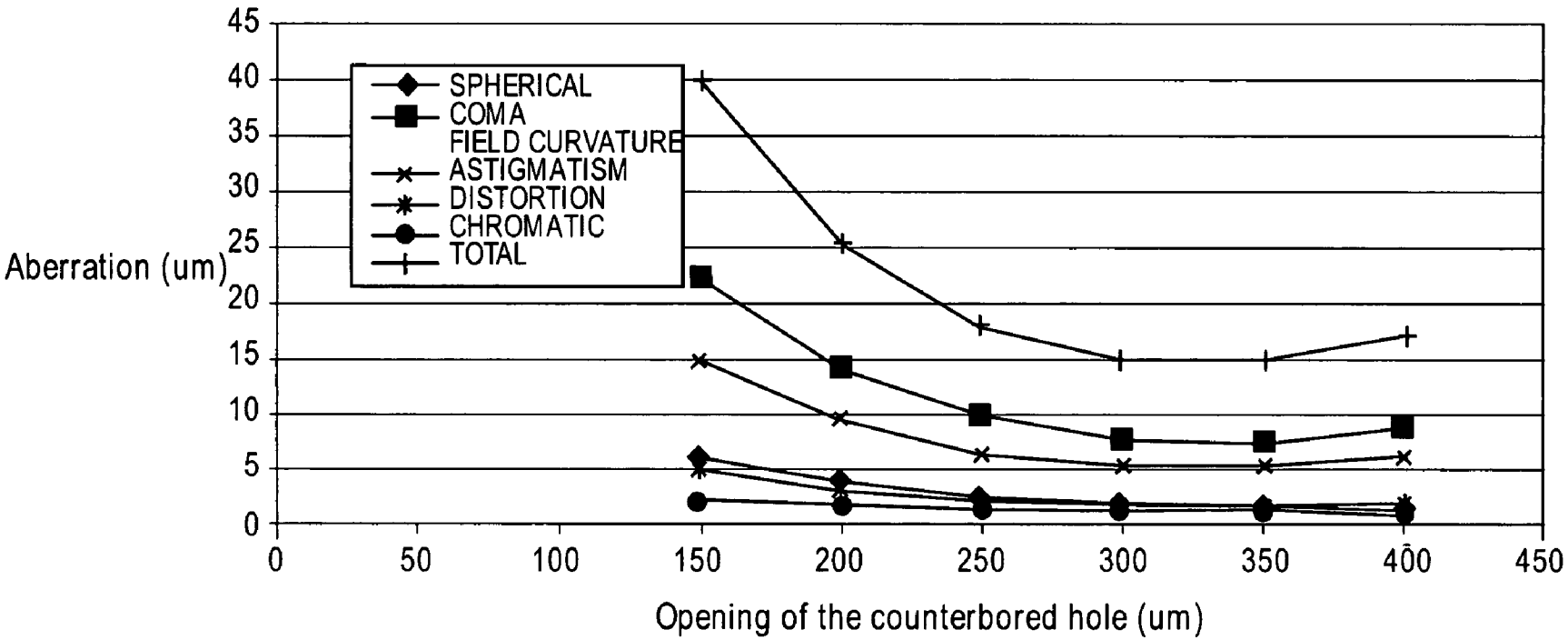
FIG. 3 shows the relationship between the single lens system aberration and the size of the counterbore.

FIG. 3 shows the optimization of the single lens design for a 100 μm diameter aperture in a 500 μm thick electrode. For a certain aperture size, there is an optimal counterbored hole design to reduce the lens aberration. For this example, the aberration reaches its minimum value when the counterbored opening is about 300 μm in diameter (for a depth of 150 μm) for 100 μm diameter aperture of 500 μm lenth. The optimal design varies with different single lens aperture size.

Figure 4A:
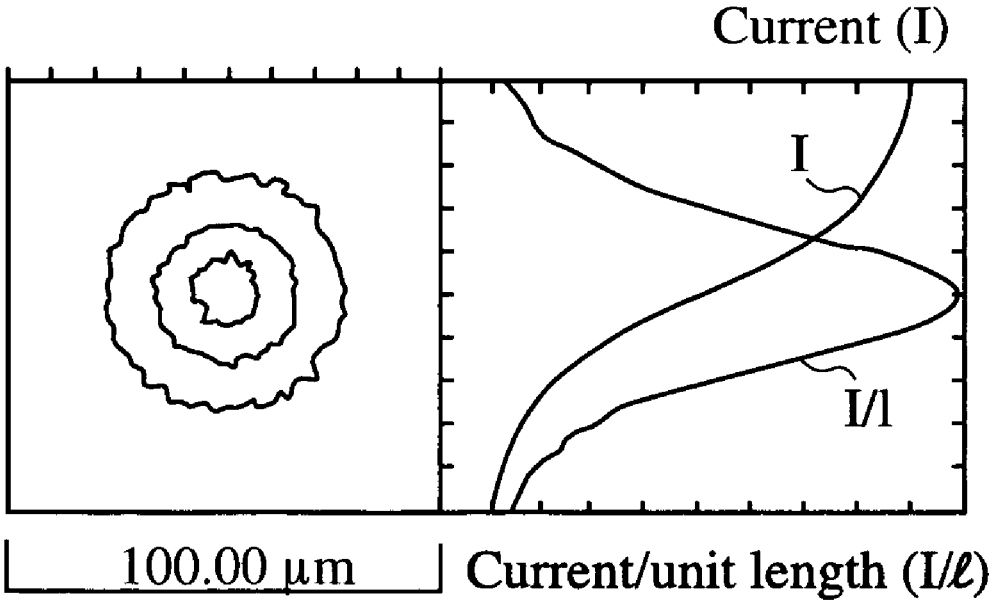
FIGS. 4A, B are simulation results of a single lens system with a straight aperture and with a counterbored aperture, respectively.
Figure 4B:
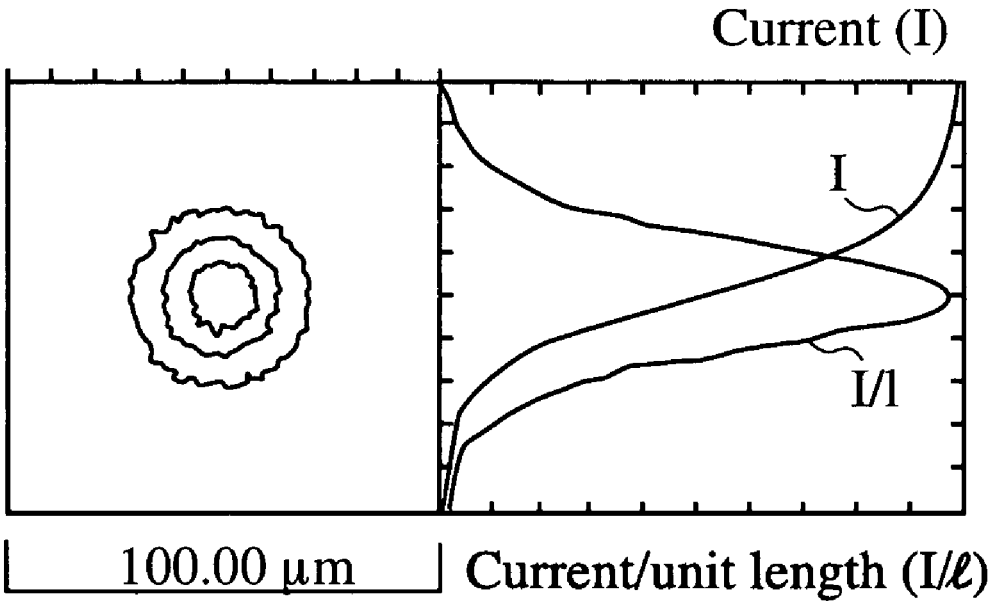

FIGS. 4A, B are plots of beam profile using the PLOTC program of Munro's code. As shown, smaller beam spot is achieved using a counterbored electrode hole. Also shown are plots of current and current/unit length distributions.

Figure 5A:
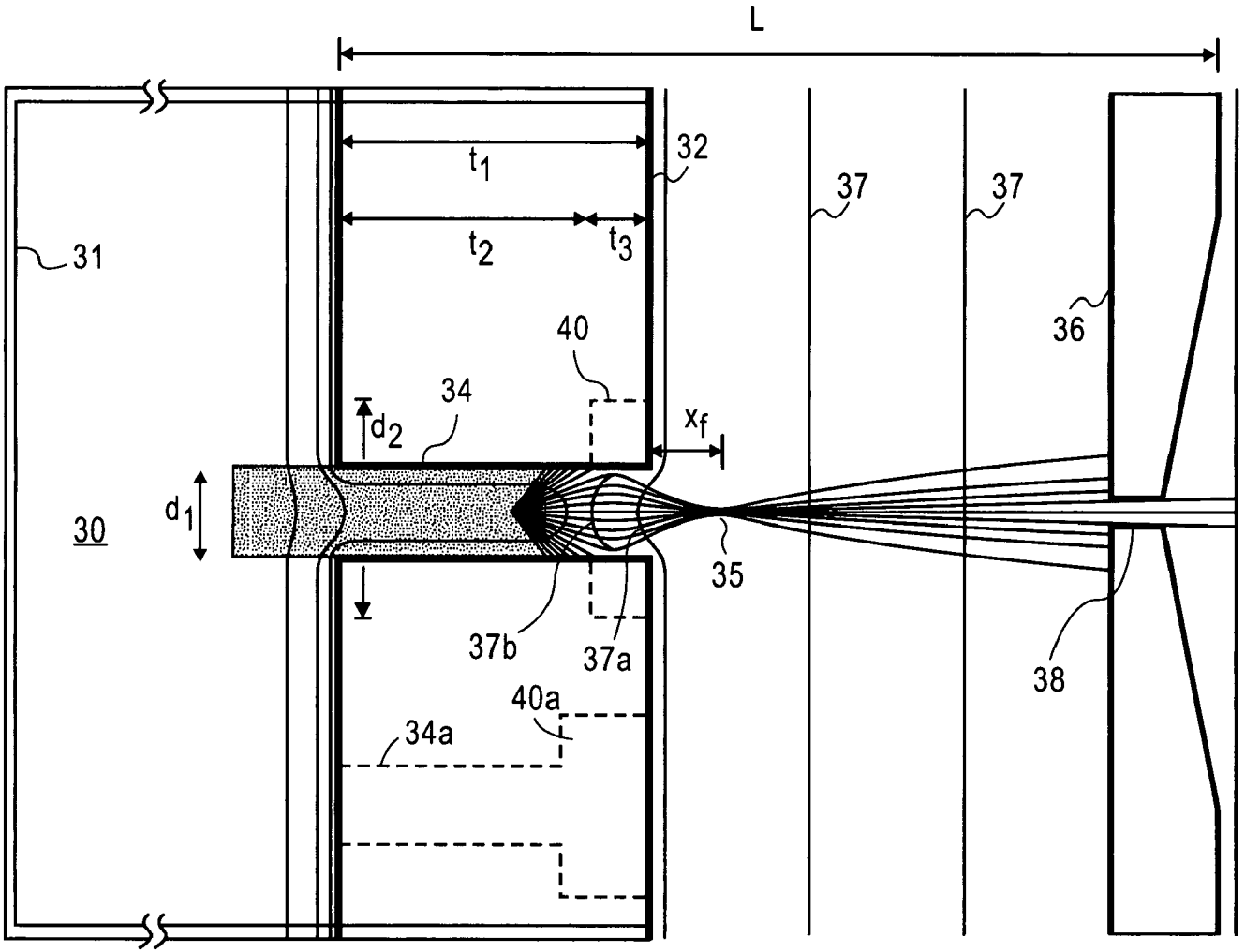
FIGS. 5A, B show an ion source with an IGUN simulation of the extraction of ion beams from the plasma electrode, and a multi-beamlet FIB system with the ion source.

FIG. 5A schematically illustrates a typical configuration of the exit and extraction electrodes of a prior art ion source. A conventional focused ion beam system using this electrode configuration will inherently produce large aberrations, making focusing of the ion beam difficult.

Ions are produced in a plasma generation region 30 of an ion source 31 which may be of conventional design. Conventional multicusp ion sources are illustrated by U.S. Pat. Nos. 4,793,961; 4,447,732; 5,198,677, which are herein incorporated by reference. U.S. Pat. No. 6,094,012, which is herein incorporated by reference, describes a preferred ion source with a coaxial magnetic filter which has a very low energy spread. These ion sources are typically RF driven. A first electrode 32, also known as the plasma electrode or exit electrode or beam forming electrode, is positioned adjacent to plasma generation region 30. First electrode 32 has an aperture 34 formed therein through which ions are drawn from the ion generation region 30. Electrode 32 has a thickness $t_1$, e.g. 1.6 mm, and is charged to a high voltage, e.g. 50 kV. Aperture 34 has a small diameter $d_1$, e.g. 0.2 mm. Because of the small aperture diameter and the relatively large electrode thickness, the aspect ratio $AR=t_1/d_1$ is large, e.g. 1.6/0.2=8.

A second electrode 36, known as the extraction electrode, is positioned in a spaced relationship with first electrode 32, e.g. L=4.8 mm. Electrode 36 contains an aperture 38 aligned with aperture 34, and is charged to a high voltage, e.g. 43 kV. (The voltages are purely illustrative and depend on the polarity of the particles to be extracted and the desired energy.)

FIG. 5A also shows an IGUN computation result simulating the extraction of ion beams from a thick plasma electrode 32, e.g. in a Focused Ion Beam (FIB) system. The equipotential surfaces 37 are flat at a distance from the aperture 34. However, near the aperture, the equipotential surfaces 37*a*, 37*b* curve into the aperture 34, and this curvature provides a lensing effect. In this case the focal point 35 is located at a distance $x_f$ of 350 μm from the plasma electrode 34. The beam then diverges before reaching the extraction electrode 36 through which some of the beam is extracted and directed towards a target. A similar effect can be created at the extraction electrode 36, by placing a resist coated wafer very close and applying a suitable voltage, so that the beam exiting aperture 38 is focused and a demagnified beam hits the resist.

In the ion source of FIG. 5A, the addition of a downstream counterbore 40 of the present invention in the plasma electrode 32 will improve the focusing properties. The modified electrode has an aperture diameter of $d_1$ with length (thickness) $t_2$, and the counterbore has a diameter of $d_2$ and a length (depth) of $t_3$, so the total electrode thickness is $t_1=t_2+t_3$.

While the invention has been described with respect to an extraction system with a single aperture in each electrode, it also applies to multiple aperture systems, where each aperture is counterbored. FIG. 5A illustrates the inclusion of a second aperture 34*a* with its counterbore 40*a*.

Figure 5B:
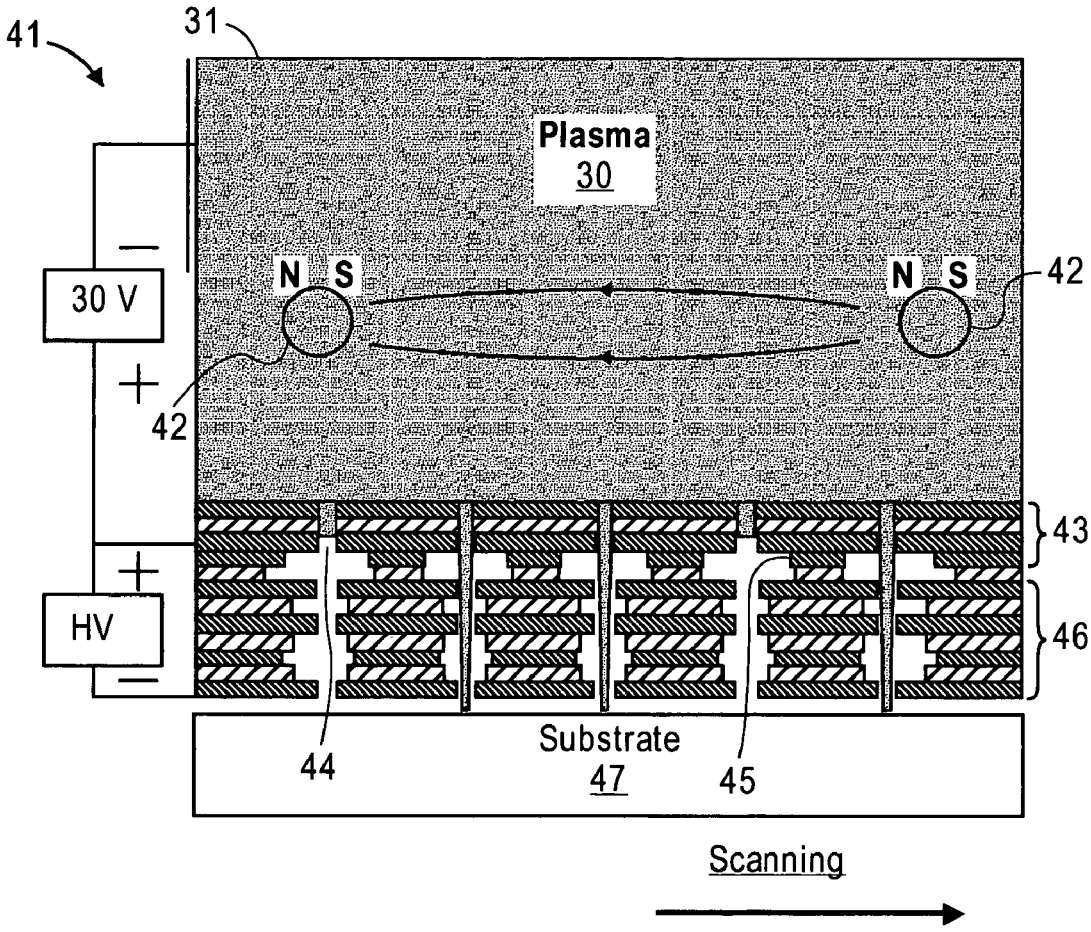

FIG. 5B illustrates a FIB system 41 formed of the ion source 31 of FIG. 5A. Ion source 31 includes a magnetic filter 42 and a multilayer multiaperture extraction electrode structure (extractor) 43. The multilayer structure of extractor 43, made of conducting electrodes separated by insulators, allows individual beamlets to be separately switched. Extractor 43 is flat and includes multiple apertures 44 with counterbores 45. Extractor 43 is followed by a plurality of lenses or electrodes separated by insulator layers which form an acceleration column 46. Column 46 includes aligned apertures for transmitting the accelerated beam to a substrate 47. A 30 V supply is connected between the ion source 31 and extractor 43 to extract the plasma ions, and a HV supply is connected across column 46 to accelerate the ions. Column 46 may include a split electrode Einzel lens to scan the beam across the substrate 47 or substrate 47 can be translated across the beams as shown by the arrow.

Figure 6A:
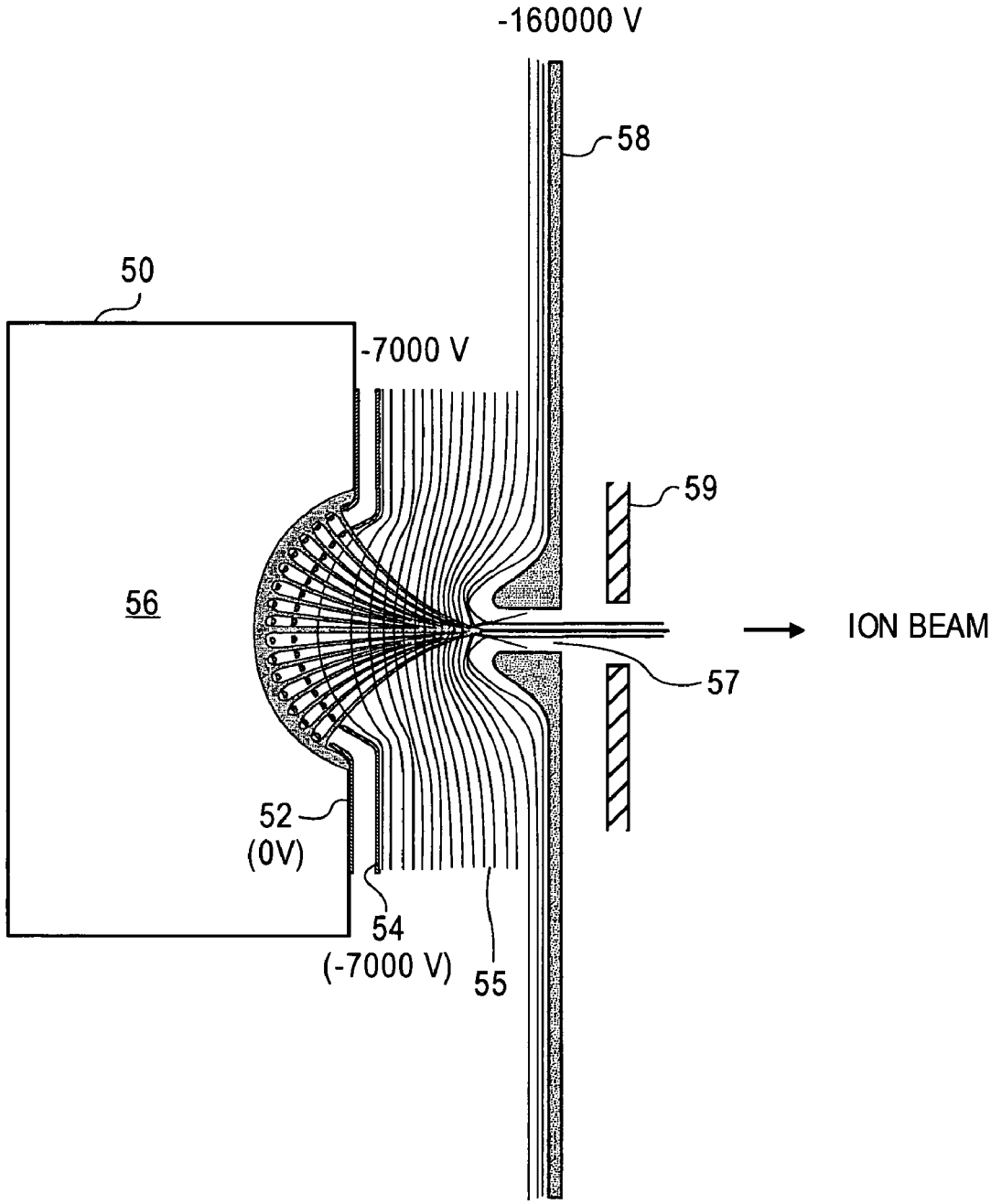
FIGS. 6A, B illustrate a counterbored multi-beamlet extraction system for multicusp plasma sources.

FIGS. 6A, B illustrate another particular configuration of a multi-aperture multi-beamlet extraction system for multicusp plasma sources in which the output ion current from a source with normal plasma density is much enhanced. This type of source can produce large areas of uniform plasma. Multi-beamlets are extracted from this extended area through holes in a curved surface. The extraction voltage is low (several kV) and the beamlets merge together at the high voltage electrode. From that point on the beam is compressed and becomes parallel. This beam extraction system can easily amplify the output current by an order of magnitude. It can be applied to both positive and negative ion beams.

As shown in FIG. 6A, ion source 50 may include a pair of spaced multi-aperture electrodes, plasma electrode 52 and extraction electrode 54, at one end thereof. Either electrode 52 or 54 may include the counterbore 60 of the present invention. Electrodes 52, 54 electrostatically control the passage of ions from plasma 56 out of ion source 50. Electrodes 52, 54 are substantially spherical or curved in shape (e.g. they are a portion of a sphere, e.g. a hemisphere) and contain many aligned holes 53 (shown more clearly in FIG. 6B) over their surfaces so that ions radiate out of ion source 50. Suitable extraction voltages are applied to electrodes 52, 54, e.g. plasma electrode 52 is at 0 kV and extraction electrode 54 is at −7 kV, so that positive ions are extracted.

Figure 6B:
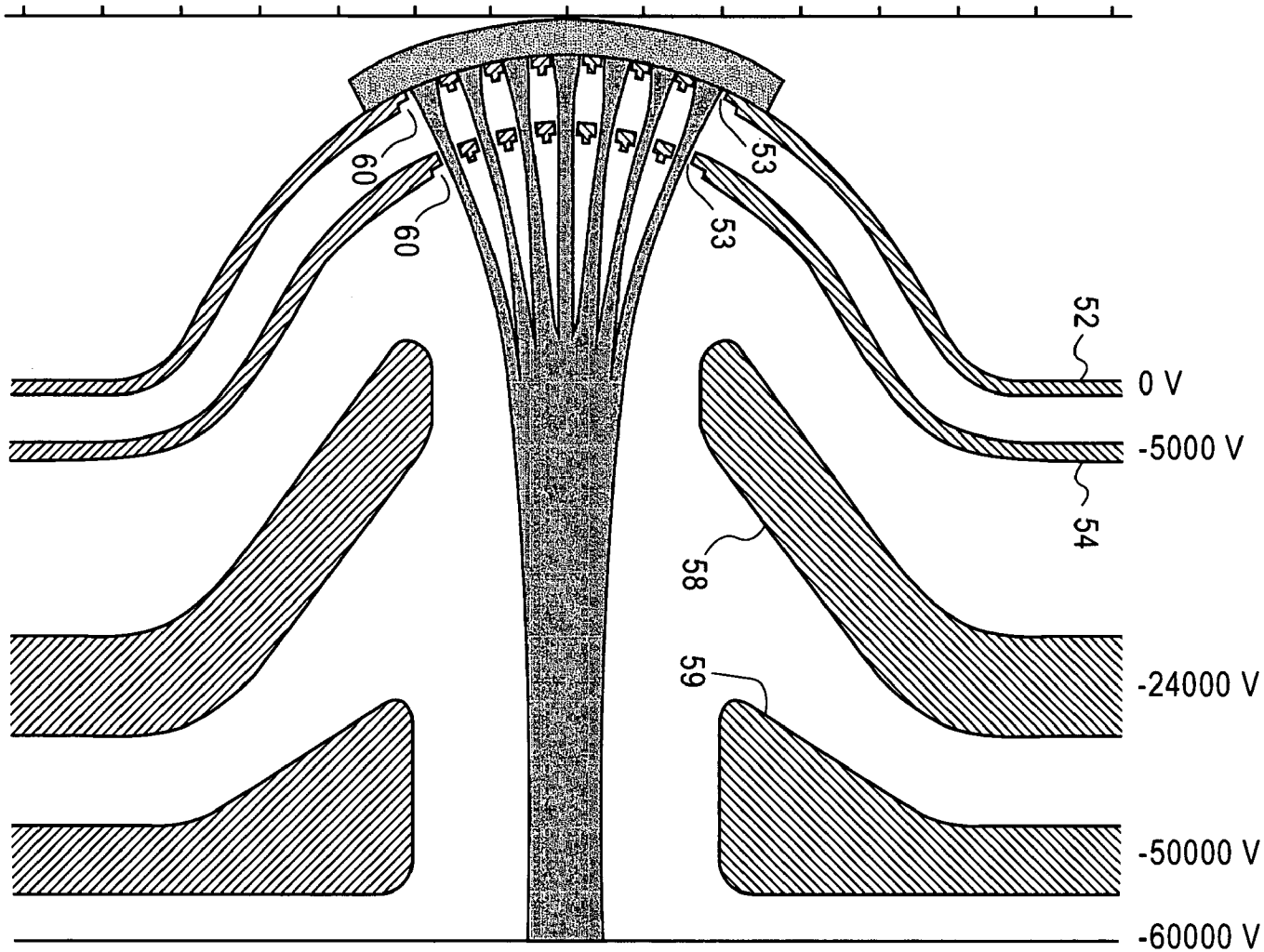

The extraction system of FIG. 6A is followed by a third electrode 58 which contains a central aperture 57 therein. Electrode 58 is at a relatively high negative voltage, e.g. 31 160 kV, to accelerate the extracted ion beam. More acceleration electrodes, e.g. electrode 59, may also be used. The two electrode extraction system is used to extract a high current ion beam. The spherical shapes of the plasma and extraction electrodes 52, 54 are such that the ion beams (or beamlets) passing through all the holes 53 in electrodes 52, 54 are focused together and the additional electrodes 58, 59 also form a parallel beam. FIG. 6B illustrates another extractor embodiment similar to FIG. 6A with different shaped electrodes 58, 59 and different voltages.

The above applies to all charged particles, e.g. positive ions, negative ions, and electrons, that can be extracted from a plasma ion source. This kind of single lens design can be used in a focused ion beam system for micromachining or lithography, and in ion projection lithography. The improved extractor system of the invention can be utilized in many different ion beam systems, including the following. All cited patents and patent applications are herein incorporated by reference.

A compact Focussed Ion Beam (FIB) system using a multicusp ion source and a novel electrostatic accelerator column to generate ion beams of various elements with final beam spot size <0.1 μm and current in the μA range for resist exposure, surface modification and doping is described in U.S. Pat. No. 5,945,677.

A Maskless Micro-ion-beam Reduction Lithography (MMRL) system eliminates the first stage of a conventional IPL machine, replacing the stencil mask by a patternable multi-beamlet system or universal pattern generator that is also the extractor system for the ion source. The MMRL system is described in U.S. application Ser. No. 09/289,332. A related system using a fixed pattern mask as the extractor is described in U.S. Pat. No. 6,486,480.

The Maskless Nano-Beam Lithography (MNBL) system described in U.S. application Ser. No. 09/641,467 is a proximity print type of lithography system rather than a projection system. It takes a combined approach of certain aspects of the MMRL and FIB systems, and eliminates the accelerator or reduction column. It employs the same beamlet switching technique as MMRL, i.e. a universal pattern generator. Unlike the FIB system, which operates with four or more electrodes, the MNBL system contains a single ion beam focusing element which is part of the beam extractor.

The system is a direct print or proximity print system, i.e. no reduction column is used to demagnify a mask pattern to produce small feature size. The wafer or substrate to be exposed is placed very close to the mask or pattern generator. However, instead of a mere 1:1 projection of the mask or pattern generator feature sizes, reduction by factors of at least 10 to 30 or more can be produced by using the focusing properties of the plasma generator extraction system. The mask or pattern generator of the lithography system is used as the exit or extraction electrode of the plasma generator. While a simple fixed pattern mask can be used, a universal pattern generator is preferred since it can produce various patterns. Both types of masks are much thicker than the conventional stencil masks used in ion beam systems. By applying a low voltage to the pattern generator/exit electrode, beamlets of low energy plasma are extracted. By applying a high voltage between the pattern generator/exit electrode and the substrate, the extracted beamlets can be focused onto the substrate, providing the desired demagnification without a reduction column. The counterbore of the present invention improves focusing.

Thus the invention provides an improved ion source extraction system, and ion sources and ion source systems with the improved extraction system. One or more extraction electrodes with one or more extraction apertures have a counterbore to reduce aberrations and increase focusing.

Changes and modifications in the specifically described embodiments can be carried out without departing from the scope of the invention which is intended to be limited only by the scope of the appended claims.

The invention claimed is:

1. An extraction system for a plasma ion source, comprising:

a first electrode having at least one aperture therein for extracting ions from an adjacent plasma;

a counterbore around each aperture on the opposed side from the plasma.

2. The extraction system of claim 1 wherein the counterbore has a diameter substantially greater than the aperture.

3. The extraction system of claim 1 wherein the aperture has a diameter of about 100 μm and a length of about 500 μm, and the counterbore has a diameter of about 300 μm and a depth of about 150 μm to about 250 μm.

4. The extraction system of claim 1 further comprising a second electrode spaced apart from the first electrode and having an aperture aligned with each aperture of the first electrode.

5. The extraction system of claim 4 further comprising means to apply voltages to the electrodes.

6. The extraction system of claim 1 wherein the electrode has a single aperture.

7. The extraction system of claim 1 wherein the electrode has multiple apertures.

8. A plasma ion source, comprising:

a plasma generating region;

the extraction system of claim 1 positioned adjacent the plasma generating region.

9. The plasma ion source of claim 8 wherein the counterbore has a diameter substantially greater tan the aperture.

10. The plasma ion source of claim 8 wherein the aperture has a diameter of about 100 μm and a length of about 500 μm, and the counterbore has a diameter of about 300 μm and a depth of about 150 μm to about 250 μm.

11. The plasma ion source of claim 8 further comprising a second electrode spaced apart from the first electrode and having an aperture aligned with each aperture of the first electrode.

12. The plasma ion source of claim 11 further comprising means to apply voltages to the electrodes.

13. The plasma ion source of claim 8 wherein the electrode has a single aperture.

14. The plasma ion source of claim 8 wherein the electrode has multiple apertures.

15. A method of reducing aberrations and improving focusing of an extraction system electrode for a plasma ion source, comprising:

providing a counterbore around each aperture in the electrode on an opposed side of the electrode from a plasma generating region.

16. The method of claim 15 wherein the counterbore has a substantially greater diameter than the aperture.

17. The method of claim 15 further comprising applying a voltage to the electrode to produce an electric field whose equipotential lines extend into the counterbore.

18. An extraction system for a plasma ion source, comprising:

a first electrode having at least one aperture therein for extracting ions from an adjacent plasma;

a counterbore around each aperture on the opposed side from the plasma; and a magnetic filter to reduce the energy spread of the extracted ions.

19. An extraction system for a plasma ion source, comprising:

a multicusp plasma generator;

a first electrode having at least one aperture therein for extracting ions from an adjacent plasma generated in the multicusp plasma generator;

a counterbore around each aperture on the opposed side from the plasma.

20. An extraction system for a plasma ion source, comprising:

a first electrode having at least one separately switched aperture therein for extracting ions from an adjacent plasma, wherein each aperture ion extraction is a beamlet; and a counterbore around each aperture on the opposed side from the plasma.

21. A method of reducing aberrations and improving focusing of an extraction system electrode for a plasma ion source, comprising:

providing a counterbore around each of a plurality of switchable apertures in an electrode on an opposed side of the electrode from a plasma generating region, whereby each aperture is capable of extracting a beamlet from the plasma generating region; and separately switching each beamlet.

22. An extraction system for a plasma ion source, comprising:

a first electrode having at least one aperture therein for extracting ions from an adjacent plasma;

a counterbore around each aperture on the opposed side from the plasma;

wherein the aperture has a diameter of about 100 μm and a length of about 500 μm, and the counterbore has a diameter of about 300 μm and a depth of about 150 μm to about 250 μm.

23. An extraction system for a plasma ion source, comprising:

a plasma generating region;

a first electrode having at least one aperture therein for extracting ions from an adjacent plasma, forming an extraction system, the extraction system positioned adjacent the plasma generating region; and a counterbore around each aperture on the opposed side from the plasma, wherein the aperture has a diameter of about 100 μm and a length of about 500 μm, and the counterbore has a diameter of about 300 μm and a depth of about 150 μm to about 250 μm.

* * * * *